US007647006B2

(12) United States Patent
Nakamura et al.

(10) Patent No.: US 7,647,006 B2
(45) Date of Patent: Jan. 12, 2010

(54) IMAGE FORMING APPARATUS HAVING ENDLESS BELT

(75) Inventors: Masakazu Nakamura, Hachioji (JP); Masami Maruko, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 473 days.

(21) Appl. No.: 11/645,046

(22) Filed: Dec. 22, 2006

(65) Prior Publication Data

US 2007/0231025 A1 Oct. 4, 2007

(30) Foreign Application Priority Data

Mar. 29, 2006 (JP) ..... 2006-090554
Oct. 17, 2006 (JP) ..... 2006-282322

(51) Int. Cl.
*G03G 15/00* (2006.01)
*G03G 15/01* (2006.01)
*G03G 15/16* (2006.01)
*G03G 15/20* (2006.01)

(52) U.S. Cl. ..... 399/165; 399/302; 399/303; 399/312; 399/329

(58) Field of Classification Search ..... 399/162, 399/165, 302, 303, 312, 329
See application file for complete search history.

(56) References Cited

U.S. PATENT DOCUMENTS 5,153,655 A * 10/1992 Suzuki et al. ..... 399/329
5,235,395 A * 8/1993 Ishiwata ..... 399/329
5,343,279 A * 8/1994 Nagata et al. ..... 399/329
6,501,936 B1 * 12/2002 Sato ..... 399/329
7,317,892 B2 * 1/2008 Ito et al. ..... 399/329
7,383,012 B2 * 6/2008 Sata ..... 399/329
7,505,725 B2 * 3/2009 Katayama et al. ..... 399/329

FOREIGN PATENT DOCUMENTS

JP 2003-241554 A 8/2003

* cited by examiner

*Primary Examiner*—William J Royer
(74) *Attorney, Agent, or Firm*—Frishauf, Holtz, Goodman & Chick, P.C.

(57) ABSTRACT

An image forming apparatus includes a plurality of rotors, and an endless belt that is supported with tension by the plurality of rotors and rotated by the rotors. Herein, at least one of the plurality of rotors is provided, at a first end, with a belt restraining member that has a restraining face for restraining displacement of the endless belt toward the first end and that is rotatable with respect to the rotor; and the belt restraining member is arranged such that an angle between the restraining face of the belt restraining member and a rotation shaft of the rotor is greater at a contact start point at which the endless belt begins contact with the belt restraining member during rotation than at a contact end point at which the endless belt ends contact with the belt restraining member during rotation.

10 Claims, 5 Drawing Sheets

IMAGE FORMING APPARATUS HAVING ENDLESS BELT

This application is based on Japanese Patent Applications No. 2006-090554 filed on Mar. 29, 2006, and No. 2006-282322 filed on Oct. 17, 2006 in the Japanese Patent Office, the entire contents of which are hereby incorporated by reference.

FIELD OF THE INVENTION

The present invention relates to an image forming apparatus provided with an endless belt for conveying a recording material.

BACKGROUND OF THE INVENTION

An image forming device by an electrophotographic method, such as a copier, printer, facsimile, or multi-function center having various functions of these devices, forms a latent image on a photoreceptor, corresponding to an original document sheet, develops the latent image by adding toner, transfers the developed toner image onto a recording medium, fixes the toner image transferred on the recording medium, and ejects the recording medium.

To form a color image, an image forming device forms four latent images in Y (yellow), M (magenta), C (cyan), and K (black) colors, corresponding to colors on an original document sheet, on a photoreceptor drum, primarily transfers developed toner images of four colors onto an intermediate transferrer constructed with an endless belt, then secondarily transfers a composite toner image of the four toner images onto a recording medium, fixes the toner image transferred onto the recording medium, and ejects the recording medium.

Further, as a fixing device for fixing toner images in such a way, there is a fixing device of a belt fixing type which includes a fixing belt that is supported with tension by a heating roller with a built-in heater, such as a halogen heater, and a fixing roller, and is driven in circulation. The fixing device further includes a pressure roller for pressing the fixing roller through the fixing belt. The fixing device heats and presses a recording medium, onto which a toner image has been transferred, at a nip section formed by the fixing belt and pressure roller, while sandwiching and conveying the recording medium. Such a fixing device, including a fixing belt and heating roller with small thermal capacities, has advantages of shortening warming-up time and energy saving.

However, a conveying device employing an intermediate transferrer, fixing belt, and recording medium conveying belt in an endless form has a problem that an endless belt supported with tension by rollers is displaced to one side or the other of the rollers or obliqued. If a side face of a belt is received by a fixed shaft or a belt guide member of a rigid body that does not move along the roller axis, a problem tends to occur in that the pushing force applied to the side face of the belt becomes large, and the belt gets on the belt guide member or the side face of the belt gets broken.

As a solution of the problems described above, an example in a prior art is shown in FIG. 6 where displacement of a fixing belt is restrained. FIG. 6 shows an example of a fixing device in a prior art having a structure to restrain displacement of an endless fixing belt. As shown in FIG. 6, disclosed is a technology for absorbing displacement and obliquity of a belt 927 such that a spring 912 receives a belt-guide-lib 911 (belt restrain member) disposed on a side face of a roller 910 near the end thereof. (For example, refer to Japanese Patent Publication TOKKAI No. 2003-241554)

However, the following problem has not been solved even by this method. That is, for example, when a jam of a recording medium has occurred on the fixing belt 927, a large pushing force toward a side face of the roller 910 is generated on the fixing belt 927. Consequently, the side face of the fixing belt 927 gets on one of the belt restraining members 911 provided at the both ends of the roller 910 and gets deformed, or a side end portion of the fixing belt 927 enters the gap between the roller 910 and the belt restraining member 911, thus the fixing belt 927 being damaged.

In an aspect of the present invention, there is provided the following structure.

An image forming apparatus, comprising:

a plurality of rotors; and an endless belt that is supported with tension by the rotors and that is rotated by the rotors, wherein at least one of the plurality of rotors is provided at a first end with a belt restraining member that has a restraining face for restraining displacement of the endless belt toward the first end and that is freely rotatable with respect to the rotor; and wherein the belt restraining member is arranged such that an angle between the restraining face of the belt restraining member and a rotation shaft of the rotor is greater at a contact start point at which the endless belt begins contact with the belt restraining member during rotation than at a contact end point at which the endless belt ends contact with the belt restraining member during rotation.

DETAILED DESCRIPTION OF THE PREFERRED EMBODIMENT

Figure 1:
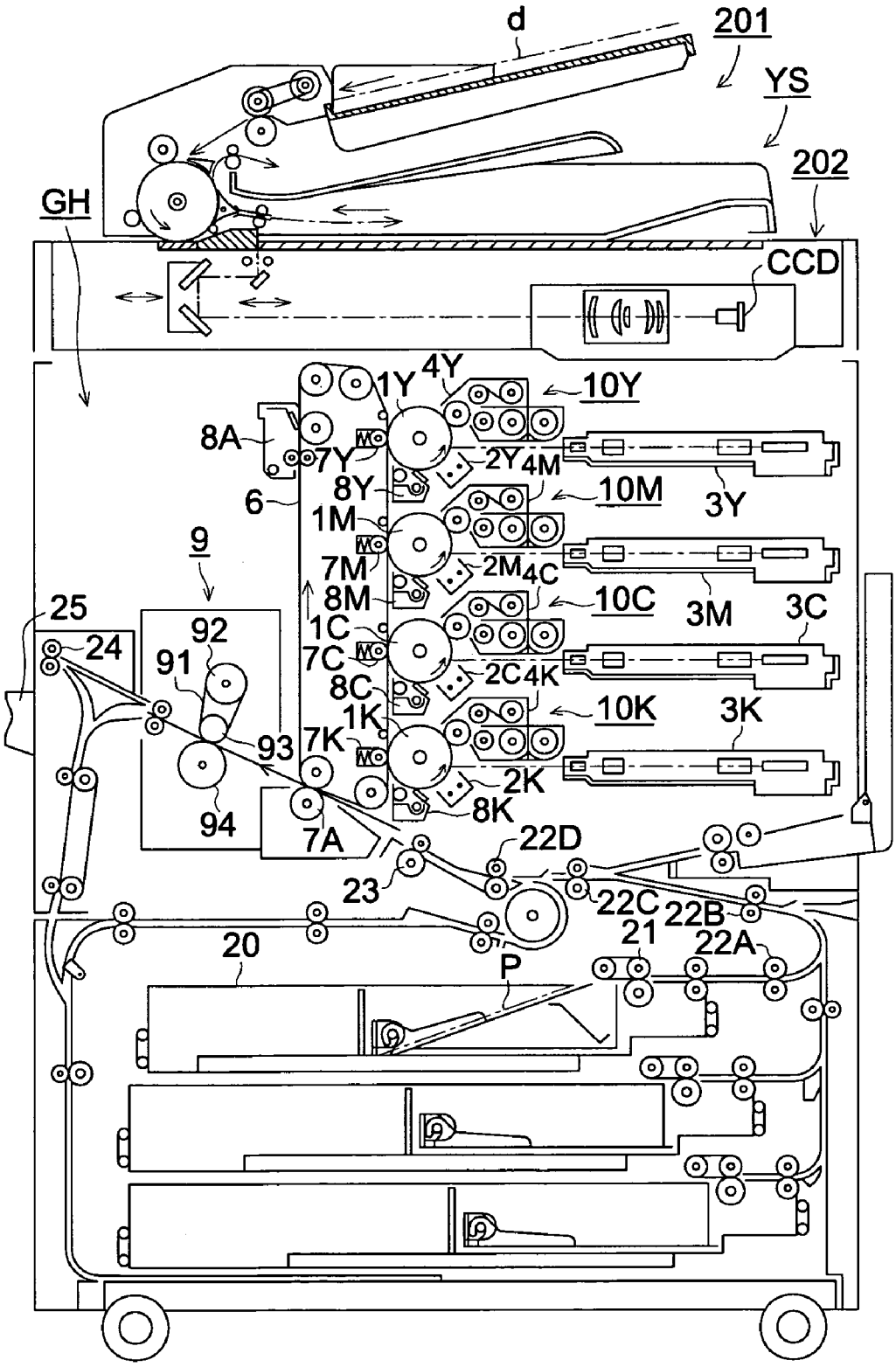
FIG. 1 is a cross-sectional view of a structure of an image forming apparatus in accordance with an embodiment of the present invention.

FIG. 1 is a cross-sectional view of the structure of an image forming apparatus in accordance with an embodiment of the present invention.

The image forming apparatus is constructed with an image-forming-apparatus main body GH and an image reading device YS. The image-forming-apparatus main body GH is called a tandem type color image forming device and includes plural image forming sections 10Y, 10M, 10C and 10K, an intermediate transferrer 6 in a belt-form, a sheet conveying unit, a fixing device 9, and the like.

The image reading device YS is installed on the image-forming-apparatus main body GH. The image reading device YS includes an automatic original-document-sheet conveying device 201 and an original-document-sheet image scanning exposure device 202. An original document sheet d loaded on an original document sheet table of the automatic original-document-sheet conveying device 201 is conveyed by a conveying unit, an image on a single side or each of images on double sides of the original document sheet d is scan-exposed by an optical system of the original-document-sheet image scanning exposure device 202, and the image is read into a line image sensor CCD.

A signal formed by photoelectric conversion with the line image sensor CCD is subjected to analog processing, A/D conversion, shading adjustment, image compression processing, and the like in an image processing section, and then conveyed to exposure units 3Y, 3M, 3C, and 3K.

The image forming section 10Y that forms an image in yellow color (Y) includes a photoreceptor 1Y, a charging unit 2Y, the exposure unit 3Y, a developing device 4Y and a cleaning unit 8Y which are disposed around the photoreceptor 1Y. The image forming section 10M that forms an image in magenta color (M) includes a photoreceptor 1M, a charging unit 2M, the exposure unit 3M, a developing device 4M and a cleaning unit 8M which are disposed around the photoreceptor 1M. The image forming section 10C that forms an image in cyan color (C) includes a photoreceptor 1C, a charging unit 2C, the exposure unit 3C, a developing device 4C and a cleaning unit 8C which are disposed around the photoreceptor 1C. The image forming section 10K that forms an image in black color (K) includes a photoreceptor 1K, a charging unit 2K, the exposure unit 3K, a developing device 4K and a cleaning unit 8K which are disposed around the photoreceptor 1K. The charging unit 2Y and the exposure unit 3Y, the charging unit 2M and the exposure unit 3M, the charging unit 2C and the exposure unit 3C, and the charging unit 2K and the exposure unit 3K construct latent image forming units.

The developing devices 4Y, 4M, 4C and 4K contain toners of yellow (Y), magenta (M), cyan (C), and black (K) of fine particles, and a 2-component developing agent.

The intermediate transferrer 6 is wound around plural rollers, which are rotors, and driven in circulation.

The fixing device 9 is provided with an endless fixing belt 91 which is supported with tension by two rotors, namely, a heating roller 92 and fixing roller 93, and is driven in circulation. The fixing device 9 is also provided with pressure roller 94 for pressing the fixing roller 93 through the fixing belt 91. The fixing device 9 fixes a toner image on a recording medium P with heat and pressure at a nip section N formed between the fixing belt 91 and the pressure roller 94.

With this structure, images in respective colors formed by the image forming sections 10Y, 10M, 10C, and 10K are sequentially transferred onto the circulating intermediate transferrer 6 by transferring units 7Y, 7M, 7C, and 7K (primary transfer), and thus a toner image that is a composite color image is formed. The recording medium P stored in a sheet feeding cassette 20 is fed by a sheet feeding unit 21, and conveyed through sheet feeding rollers 22A, 22B, 22C, 22D, registration roller 23, and the like to a transferring unit 7A so that the color image is transferred onto the recording medium P (secondary transfer). The recording medium P with the transferred color image is heated and pressed by the fixing device 9, and thus the color toner image on the recording medium P is fixed. Then, the recording medium P is sandwiched by ejection rollers 24 to be loaded on a sheet ejection tray 25 outside the device.

On the other hand, after the color image is transferred onto the recording medium P, residual toner is removed by a cleaning unit 8A from the intermediate transferrer 6, which has released the recording medium P by curvature separations.

An image forming apparatus for forming color images has been described above. However, the present invention is also applicable to an image forming apparatus for forming monochrome images.

Figure 2:
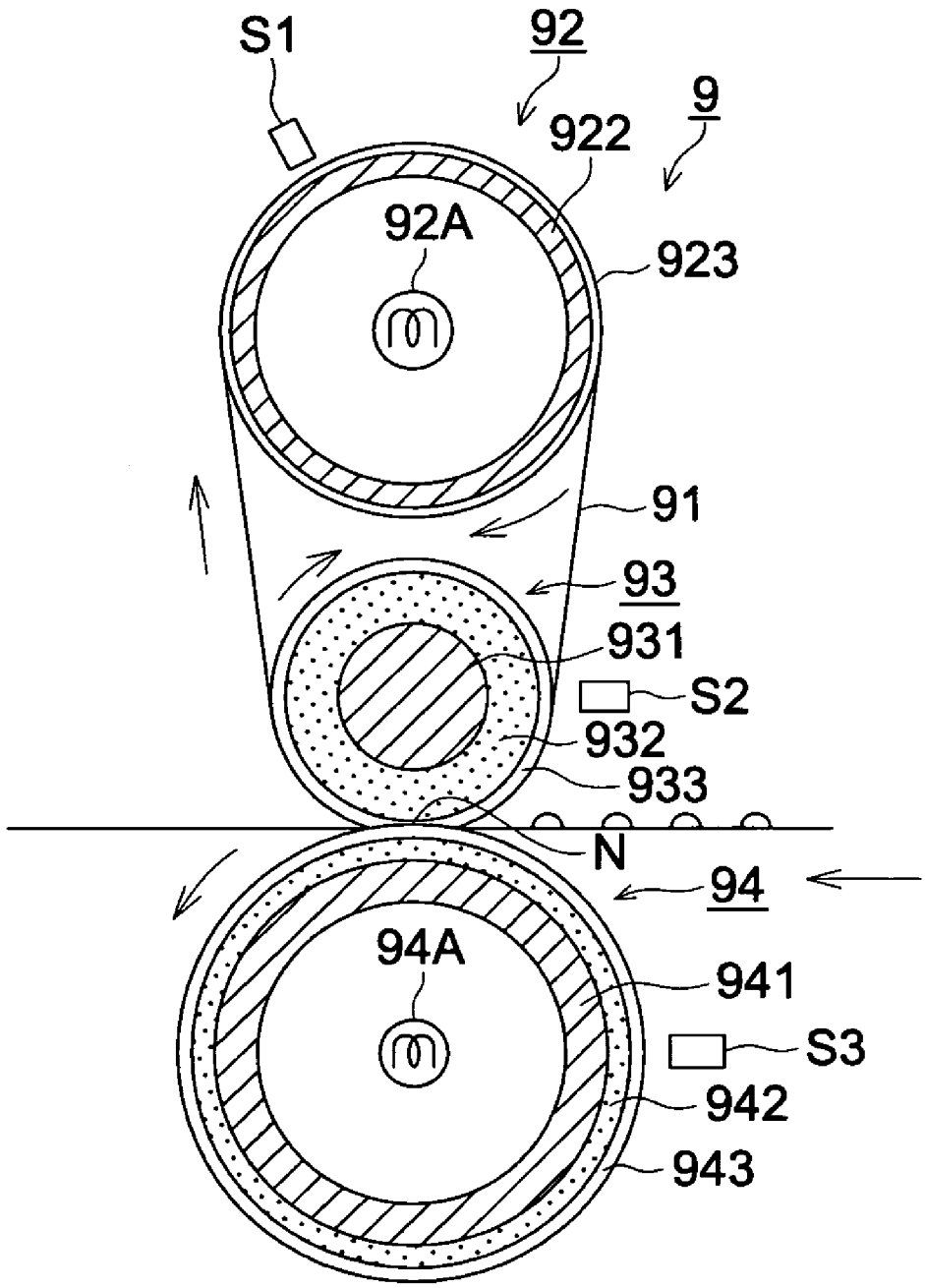
FIG. 2 is a cross-sectional view of a fixing device provided with an endless fixing belt in accordance with the embodiment.

FIG. 2 is a cross-sectional view of the fixing device 9 provided with the endless fixing belt 91, in accordance with the present embodiment.

The endless fixing belt 91 is formed, for example, by employing a heat-resisting resin belt of a 70 μm thick PI (polyimide) or the like as a base body, coating an outer circumferential surface of the base body with a 200 μm thick heat-resisting silicon rubber (hardness of 30 degree: measured by a spring type hardness meter of a durometer type A specified in JIS, K6253 (ISO 7619) as an elastic layer, and further coating with a 30 μm thick PFA (perfluoroalkoxy) tube as a surface layer. Herein, the outer diameter is 80 mm, for example.

The heating roller 92, which is one of the plural rotors, contains a built-in halogen lamp 92A as heating means for heating the fixing belt 91, and is structured as a hard roller by coating a 30 μm thick heat-resisting PFA as a surface layer 923 on the outer circumferential surface of a 2 mm thick tube-shaped hollow rotor 922 formed of aluminum or the like, for example. Herein, the outer diameter is 47 mm, for example.

The fixing roller 93, which is one of the plural rotors, is structured as a soft roller by coating a solid metal core 931 formed of a metal, such as steel, with a 10 mm thick heat-resisting silicon sponge as an elastic layer 932, and further with a 30 μm thick PFA tube as a surface layer 933, for example. Herein, the outer diameter is 40 mm, for example.

The pressure roller 94 contains a built-in halogen lamp 94A as heating means for heating the fixing belt 91, and is structured as a hard roller by coating the outer circumferential surface of a 3 mm thick tube-shaped hollow rotor 941 formed of aluminum, for example, with a 3 mm thick heat-resisting silicon rubber (hardness of 30 degree: measured by a spring type hardness meter of a durometer type A specified in JIS, K6253 (ISO 7619) as an elastic layer 942, and further coating with a 30 μm thick PFA (perfluoroalkoxy) tube as a separation layer 943. Herein, the outer diameter is 50 mm, for example.

Further, the fixing device 91 is provided with a temperature sensor S1 for detecting the temperature of the heating roller 92 through the fixing belt 91, a temperature sensor S2 for detecting the temperature of the fixing roller 93 through the fixing belt 91, and a temperature sensor S3 for detecting the temperature of the pressure roller 94.

Herein, any kind of heating unit can be used as the heating unit for heating the fixing belt 91. For example, an induction heater with an exciting coil may be used. The heating unit is not necessarily required to be disposed in the heating roller 92 or the like, and may be disposed anywhere.

The fixing device 9 may be provided with a tension roller to press the fixing belt 91.

With the structure described above, when a driving unit, not shown, rotates the fixing roller 93 clockwise, the fixing belt 91 and heating roller 92 also rotate clockwise, and the pressure roller 94 rotates counterclockwise. The fixing belt 91, which comes in contact with the heating roller 92, is heated by the halogen lamp 92A, and the pressure roller 94 is also heated by the halogen lamp 94A. The pressure roller 94 is urged toward the fixing roller 93 by an urging unit, not shown. A recording medium P having been fed is heated and pressed at the nip section N between the fixing belt 91 wound around the fixing roller 93 and the pressure roller 94, and thus a toner image on the recording medium P is fixed.

Figure 3:
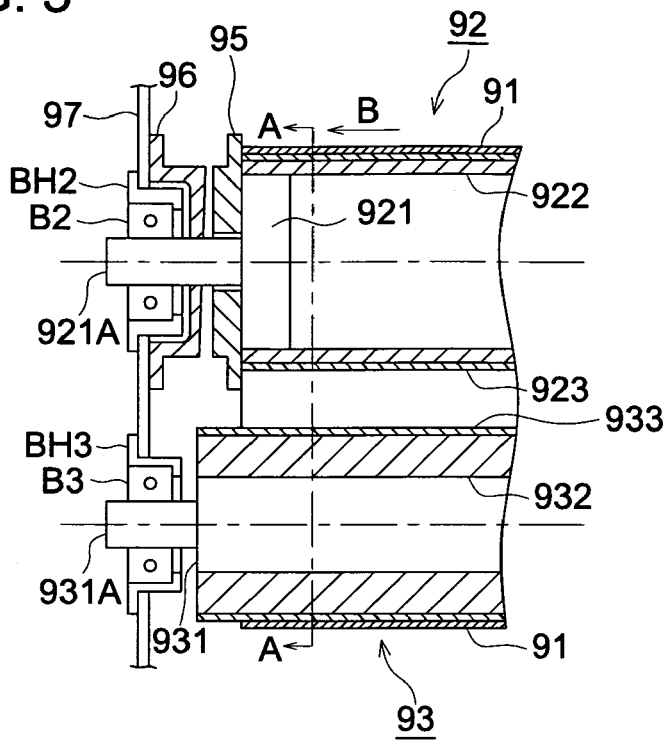
FIG. 3 is a side cross-sectional view to be referred to by the description of the structure and operation of a belt restraining member of the fixing device in accordance with the embodiment.
Figure 4:
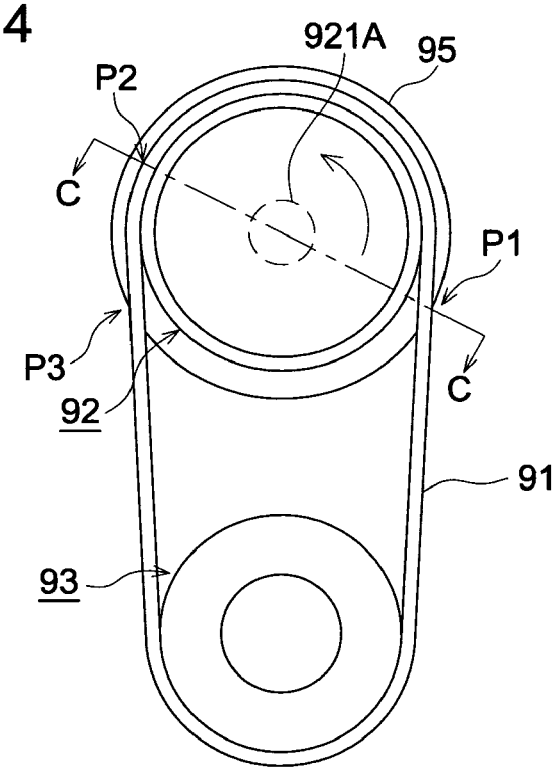
FIG. 4 is A-A cross-sectional view in accordance with FIG. 3.

FIG. 3 is a side cross-sectional view to be referred to by the description of the structure and operation of a belt restraining member of the fixing device 9 in accordance with the embodiment. FIG. 4 is A-A cross-sectional view in accordance with FIG. 3.

In FIG. 3, the heating roller 92 includes a metal core 921 press-fittingly engaged with the inner surface of the tube-shaped hollow rotor 922, and the metal core 921 has a rotation shaft 921A. The rotation shaft 921A is rotatably held by a bearing B2 fixed through a bearing holder BH2, in a direction orthogonal to a side plate 97 of the fixing device 9. The fixing roller 93 is rotatably held such that a rotation shaft 931A provided for the metal core 931 is engaged with a bearing B3 fixed to the side plate 97 through a bearing holder BH3.

One side of an angle adjusting member 96 is fixed to the surface side of the side plate 97 facing the heating roller 92, and the other side, which forms a contact section to contact a belt restraining member 95, of the angle adjusting member 96 is formed as a face (later described) having an inclination with respect to the side plate 97.

The belt restraining member 95 is provided with a center hole (given with no reference numeral) being held in engagement with the rotation shaft 921A rotatably around it, one face (given with no reference numeral) to come in contact with the above-described other side of the angle adjusting member 96, and a restraining face (given with no reference numeral) to come in contact with the fixing belt 91. The belt restraining member 95 is disposed between the angle adjusting member 96 and the heating roller 92. The engagement dimension between the center hole of the belt restraining member 95 and the rotation shaft 921A is set such that the belt restraining member 95 can smoothly rotate around the rotation shaft 921A even in a state where the one face of the belt restraining member 95 is in contact with the inclined restraining face of the angle adjusting member 96 and the belt restraining member 95 is inclined along the inclined restraining face.

The angle adjusting member 96 having the inclined face is fixed to the side plate 97 in the following manner. When the fixing belt 91 starts being displaced to the arrow direction B in FIG. 3; then the side face of the fixing belt 91 pushes the belt restraining member 95; and accordingly the belt restraining member 95 comes in contact with the inclined face of the angle adjusting member 96, the angle between the restraining face of the belt restraining member 95 and the rotation shaft 921A is greater, at a contact start point P1 (see FIG. 4) where the side face of the fixing belt 91 begins contact with the belt restraining member 95 during rotation, than at a contact end point P3 (see FIG. 4) where the contact where the side face of the fixing belt 91 ends contact with the belt restraining member 95 during rotation. Further, the angle adjusting member 96 is preferably fixed to the side plate 97, adjusting the inclination of the angle adjusting member 96 such that the angle between the restraining face of the belt restraining member 95 and the rotation shaft 921A becomes the maximum at the contact start point P1. This means, the inclination of the angle adjusting member 96 is preferably adjusted such that the angle between the restraining face and the side plate 97 becomes the maximum at the contact start point P1, because the rotation shaft 921A is held orthogonal to the side plate 97 in the present embodiment. FIGS. 5*a* and 5*b* show a structure where the angle adjusting member 96 is fixed in such a manner.

FIGS. 5*a* and 5*b* are cross-sectional views along the line C-C containing the contact start point P1 and the center of the rotation shaft 921A in FIG. 4. Herein, FIG. 5*a* shows the state where the fixing belt 91 has started being displaced and has just come in contact with the belt restraining member 95. FIG. 5*b* shows the state where the fixing belt 91 has pushed and moved the belt restraining member 95 and the belt restraining member 95 is in contact with the angle adjusting member 96.

In FIGS. 5*a* and 5*b*, the angle adjusting member 96 has an inclined face on the side in contact with the belt restraining member 95, wherein the inclined face is inclined by an angle θ with respect to the face fitted to the side plate 97. The angle adjusting member 96 is fixed to the side plate 97 such that the angle between the inclined face in contact with the belt restraining member 95 and the face fitted to the side plate 97 becomes the maximum at the contact start point P1, shown in FIG. 4, in other words, such that the angle of the inclination of the belt restraining member 95, which is shown in the C-C cross-sectional view in FIG. 5*b*, becomes θ. Herein, the angle between the inclined face of the angle adjusting member 96 in contact with the belt restraining member 95 and the face fitted to the side plate 97 can be adjusted by adjusting the direction of the angle adjusting member 96, when fitting the angle adjusting member 96 to the side plate 97.

FIG. 5*a* shows the state at the moment when there is a gap between the belt restraining member 95 and the angle adjusting member 96, and the belt restraining member 95 is not inclined yet.

FIG. 5*b* shows the state at the moment when the belt restraining member 95 is pushed by a displacement of the fixing belt 91 to the direction of arrow B and in contact with the angle adjusting member 96 during rotation, and the restraining face of the belt restraining member 95 is inclined by a degree θ with respect to the side plate 97 on the C-C cross-section where the restraining face of the belt restraining member 95 passes the contact start point P1.

Figure 5:
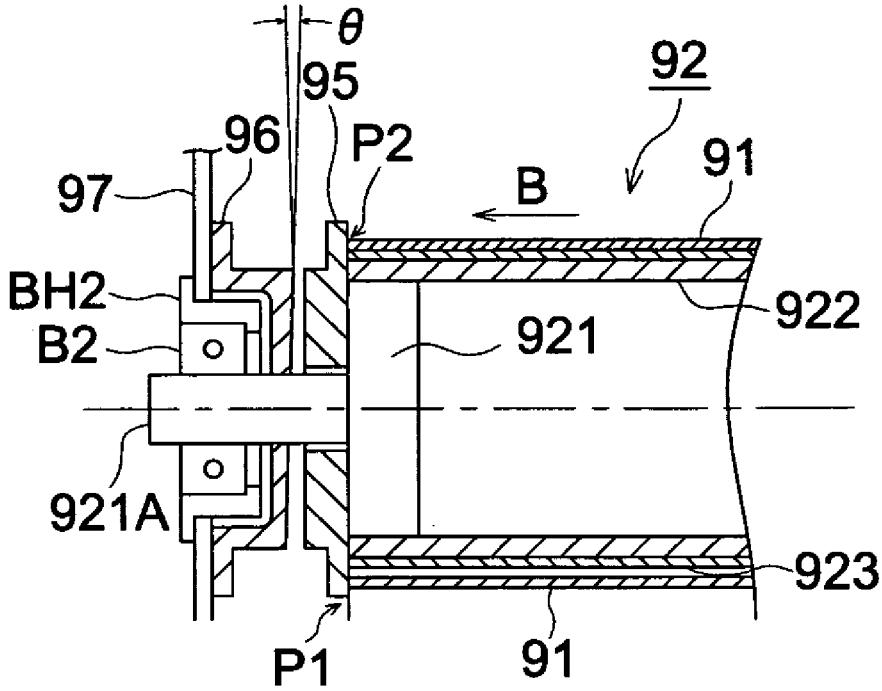
FIGS. 5*a* and 5*b* are C-C cross-sectional views in accordance with FIG. 4.
Figure 5:
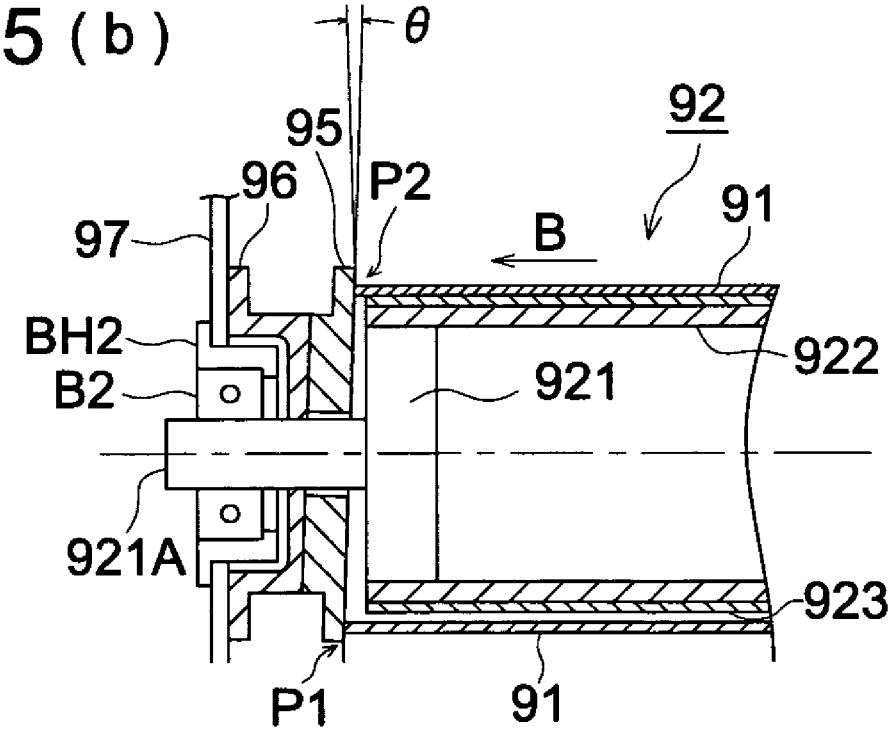
Figure 6:
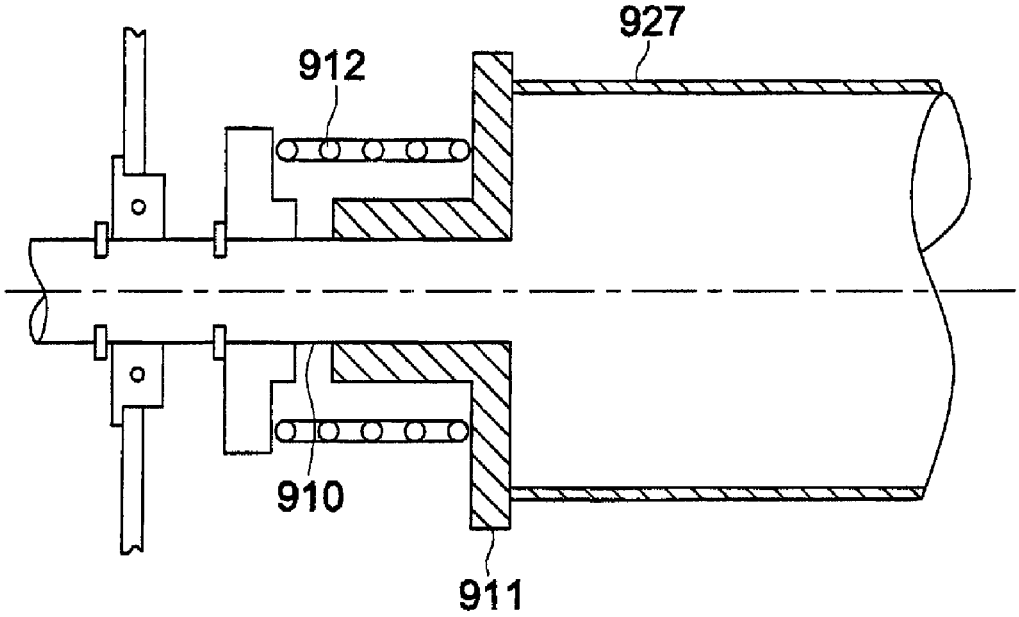
FIG. 6 PRIOR ART
FIG. 6 is a diagram showing an example of a fixing device in a prior art having a structure for restraining deviation of a fixing belt.

The contact start point P1 shown in FIGS. 4 to 5*b* is the position where the heating roller 92 rotates in the arrow direction (counterclockwise), shown in FIG. 4, and the side face of the fixing belt 91 conveyed from the fixing roller 93 to the heating roller 92 starts contact with the belt restraining member 95, and P2 is the position opposite to P1, with the center of the rotation shaft 921A, shown in FIG. 4, therebetween. In a situation where the belt restraining member 95 which has been pushed in the arrow direction B by a displacement of the fixing belt 91 and starts inclining due to a contact with the angle adjusting member 96, the point P2 is also the position where the side face of the fixing belt 91, which comes in contact with the belt restraining member 95, starts receiving a reaction force from the belt restraining member 95. Further, P3 is the contact end position where the side face of the fixing belt 91 separates from the belt restraining member 95.

After one side face of the belt restraining member 95 has come in contact with the inclined face of the angle adjusting member 96, due to a displacement of the fixing belt 91 in direction B, the belt restraining member 95 inclines. The contact start point P1 is the position where this inclination of the belt restraining member 95 forms a gap between the side face of the heating roller 92 and the restraining face of the belt restraining member 95, and this formed gap causes the contact of the side face of the fixing belt 91 with the restraining face of the belt restraining member 95 to develop smoothly even in a case where the fixing belt 91 conveyed from the fixing roller 93 to the heating roller 92 is displaced. The pushing force by the fixing belt 91 applied to the belt restraining member 95 is not uniform throughout the contact section between the fixing belt 91 and the belt restraining member 95, and is particularly large in a particular area downstream and near the contact start point P1. In accordance with the present invention, if a belt starts being displaced and comes in contact with a belt restraining member, then the belt restraining member is forced to incline by the pushing force from the belt. Thus, the pushing force by the belt applied to the belt restraining member is dispersed throughout from the contact start point P1 to the contact end point P3 smoothly and naturally. Thus, the load on the belt by the belt restraining member in a particular area downstream and near the contact start point P1 is decreased. Further, displacement of the belt is not restrained forcibly in the particular area where the pushing force is large, but displacement can be restrained using the entire contact section, having the pushing force dispersed. Accordingly, it is possible to increase the effect of restraining the displacement of the belt, while decreasing the load on the belt.

In the present embodiment, the contact section of the angle adjusting member 96 in contact with the belt restraining member 95 is formed to be an inclined face. However, the invention is not limited thereto, and the contact section may be in a stepped shape, or additional components in different heights may be provided, for example.

Inventive Example

The experiment was carried out with the above-described fixing device and the following conditions.

nip width: 16.0 mm process speed: 300 mm/sec set temperature (during waiting and passing recording sheets)
- heating roller: 200° C.
- pressure roller: 180° C.

displacing force exerted on fixing belt: 20 N, 30 N operation time:
- continuous 10 hours (with an idling time for 5 minutes every hour)

inclination angle of belt restraining member (θ):
- 0° (Comparative Example 1)
- 0.5° (Comparative Example 2)
- 1° (Inventive Example 1)
- 1.5° (Inventive Example 2)
- 2° (Inventive Example 3)
- 2.5° (Comparative Example 3)
- 3.3° (Comparative Example 4)
- 4° (Comparative Example 5)

Herein, displacing force (20N, 30N) exerted on the fixing belt 91 was set with adjustment by changing the distance between the heating roller 92 and pressure roller 94. The possibility of generation of a larger displacing force exerted on the fixing belt 91 is higher, for example, when a jam of a recording medium P has occurred on the fixing belt 91.

The result of the experiment is shown in Table 1.

TABLE 1

| | Inclination of belt restraining member (θ) | Result for belt displacing force 20N | 30N | Phenomena |
|---|---|---|---|---|
| Comparative Example 1 | 0° | A | C | Belt side-face gets on or buckles |
| Comparative Example 2 | 0.5° | A | B | Belt side-face deforms |
| Inventive Example 1 | 1° | A | A | Normal |
| Inventive Example 2 | 1.6° | A | A | Normal |
| Inventive Example 3 | 2° | A | A | Normal |
| Comparative Example 3 | 2.5° | A | B | Belt side-face deforms |
| Comparative Example 4 | 3.3° | A | C | Belt side-face enters the gap |
| Comparative Example 5 | 4° | C | C | Belt side-face enters the gap |

As shown in Table 1, when the inclination θ of the belt restraining member 95 was 0° (Comparative Example 1), stress was concentrated on the side face of the fixing belt 91 at the position P1, shown in FIGS. 3 and 4, with the displacing force exerted on the belt 91 of 30 N, and the side face of the fixing belt 91 was observed to get on the belt restraining member 95 or buckle. Thus, experiment of image forming for continuous 10 hours was not achieved.

When the inclination θ of the belt restraining member 95 was 0.5° (Comparative Example 2), experiment of image forming for continuous 10 hours was achieved. However, with the displacing force exerted on the belt 91 of 30 N, the side-face of the fixing belt 91 was observed to deform at the position P1.

When the inclination θ of the belt restraining member 95 was in a range from 1° to 2° (Inventive Examples 1 to 3), after experiment of image forming for continuous 10 hours with the displacing force exerted on the belt 91 of 20 N and 30 N, the side face of the fixing belt 91 was not observed to get on the belt restraining member 95 nor to buckle.

When the inclination θ of the belt restraining member 95 was 2.5° (Comparative Example 3), experiment of image forming for continuous 10 hours was achieved. However, with the displacing force exerted on the belt 91 of 30N, deformation was observed in such a manner that the side-face of the fixing belt 91 entered the gap between the belt restraining member 95 and the heating roller 92 at the position P1.

When the inclination θ of the belt restraining member 95 was 3.3° (Comparative Example 4), with the displacing force exerted on the belt 91 of 30 N, the side face of the fixing belt 91 was observed to enter the gap between the belt restraining member 95 and the heating roller 92 at the position P1, and the experiment of image forming for continuous 10 hours was not achieved.

When the inclination θ of the belt restraining member 95 was 4° (Comparative Example 5), with the displacing force exerted on the belt 91 of 20 N and 30 N, the side face of the fixing belt 91 was observed to enter the gap between the belt restraining member 95 and the heating roller 92 at the position P1, and the experiment of image forming for continuous 10 hours was not achieved.

From the above results of the experiment, it proved that if the angle between the restraining face of the belt restraining member 95 and the direction orthogonal to the rotation shaft 921A at the contact start point P1 is in a range from 1° to 2°, it is possible to inhibit the side face of the fixing belt 91 from getting on the belt restraining member 95 or buckling, or entering the gap, and thus increase the durability of the fixing belt 91. Consequently, the angle between the contact face of the angle adjusting member 96, the face coming in contact with the belt restraining member 95, and the belt restraining member 95 is properly adjusted by setting the angle between the restraining face of the angle adjusting member 96 and rotation shaft 921A to a range from 1° to 2°.

In the present embodiment, an example of a fixing belt 91 as an endless belt has been described. However, the present invention can be applied to any one of an intermediate transfer belt, recording medium conveying belt, and photoreceptor belt.

In accordance with the present embodiment, even in a case where a jam of a recording medium occurs on an endless belt and thereby a large pushing force is caused onto the restraining face of a belt restraining member, it is possible to decrease the pushing force so as to protect the side face of the endless belt from damage. Further, by decreasing the pushing force onto the restraining face of the belt restraining member, smooth operation and a long life of the endless belt can be achieved.

What is claimed is:

1. An image forming apparatus, comprising:

a plurality of rotors; and an endless belt that is supported with tension by the plurality of rotors and that is rotated by the plurality of rotors, wherein at least one of the plurality of rotors is provided at a first end with a belt restraining member that has a restraining face for restraining displacement of the endless belt toward the first end and that is smoothly rotatable with respect to the rotor; and wherein the belt restraining member is arranged such that an angle between the restraining face of the belt restraining member and a rotation shaft of the rotor is greater at a contact start point at which the endless belt begins contact with the belt restraining member during rotation than at a contact end point at which the endless belt ends contact with the belt restraining member during rotation.

2. The image forming apparatus of claim 1, further comprising:

an angle adjusting member for adjusting an angle of the restraining face of the belt restraining member with respect to the rotation shaft of the rotor.

3. The image forming apparatus of claim 2, wherein:

the angle adjusting member includes a contact section contactable with a face, of the belt restraining member, opposite to the restraining face; and the contact section is formed such that the restraining face of the belt restraining member is inclined from a direction orthogonal to the rotation shaft, when the belt restraining member is in contact with the contact section due to a pushing force from the endless belt.

4. The image forming apparatus of claim 1, wherein the belt restraining member is arranged such that the angle between the restraining face and the rotation shaft of the rotor becomes a maximum at the contact start point at which the endless belt begins contact with the belt restraining member during rotation.

5. The image forming apparatus of claim 1, wherein the belt restraining member is arranged such that an angle between the restraining face and a direction orthogonal to the rotation shaft of the rotor is in a range from 1 degree to 2 degrees at the contact start point at which the endless belt begins contact with the belt restraining member during rotation.

6. The image forming apparatus of claim 1, further comprising an additional belt restraining member provided at a second end of said at least one of the plurality of rotors.

7. The image forming apparatus of claim 1, wherein the endless belt comprises a fixing belt.

8. The image forming apparatus of claim 1, wherein the endless belt comprises an intermediate transfer belt.

9. The image forming apparatus of claim 1, wherein the endless belt comprises a recording medium conveying belt.

10. The image forming apparatus of claim 1, wherein the endless belt comprises a photoreceptor belt.

* * * * *